US007594875B2

(12) United States Patent
Zeilinger et al.

(10) Patent No.: US 7,594,875 B2
(45) Date of Patent: Sep. 29, 2009

(54) ARCHED CLIMBING PANEL

(75) Inventors: Brian K. Zeilinger, Janesville, WI (US); Richard R. Popp, Beloit, WI (US)

(73) Assignee: PlayStar, Inc., Janesville, WI (US)

( * ) Notice: Subject to any disclaimer, the term of this patent is extended or adjusted under 35 U.S.C. 154(b) by 743 days.

(21) Appl. No.: 10/962,094

(22) Filed: Oct. 8, 2004

(65) Prior Publication Data

US 2006/0079379 A1 Apr. 13, 2006

(51) Int. Cl.
*A63B 17/00* (2006.01)
*A63B 9/00* (2006.01)

(52) U.S. Cl. ..... 482/37; 482/35

(58) Field of Classification Search ..... 482/23, 482/35–37, 51, 142, 148; D21/814, 826, D21/827, 811, 818–825, 483, 489–492, 503, D21/506; D25/62–64; 434/247; 472/116; 52/86, 87, 182, 245; 119/702, 705, 706, 119/847; 446/476

See application file for complete search history.

(56) References Cited

U.S. PATENT DOCUMENTS

| | | | | | |
|---|---|---|---|---|---|
| 796,159 | A | | 8/1905 | Smolik | |
| 1,441,940 | A | * | 1/1923 | Nafe | 472/114 |
| 2,622,658 | A | * | 12/1952 | Morgan | 182/33.2 |
| D176,999 | S | | 3/1956 | Ahrens | |
| 2,768,828 | A | * | 10/1956 | Pack | 482/35 |
| D187,704 | S | * | 4/1960 | Deeds | D21/818 |
| 3,485,494 | A | | 12/1969 | Liberman | |
| D218,460 | S | | 8/1970 | Dattner | |
| 3,572,698 | A | | 3/1971 | Greenly | |
| D223,460 | S | | 4/1972 | Anrens | |
| 3,780,469 | A | | 12/1973 | Hancovsky | |
| 3,831,934 | A | | 8/1974 | Hancovsky | |
| D235,792 | S | * | 7/1975 | Wormser | D21/826 |

(Continued)

FOREIGN PATENT DOCUMENTS

CA 2058493 A * 9/1992

(Continued)

OTHER PUBLICATIONS

Admitted Prior Art Inclined Rock Climber, #757-2, Miracle Recreation Equipment Company, Dec. 1998, p. 69.

(Continued)

*Primary Examiner*—Loan H Thanh
*Assistant Examiner*—Victor K Hwang
(74) *Attorney, Agent, or Firm*—Michael Best & Friedrich LLP

(57) ABSTRACT

A climbing panel includes a body that is curved about an axis at a non-constant radius of curvature. The body has first and second end portions and is configured for use such that one of the first and second end portions is supported by a support surface and the other of the first and second end portions is coupled to an elevated support structure. The body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height.

33 Claims, 5 Drawing Sheets

U.S. PATENT DOCUMENTS

| | | | | | |
|---|---|---|---|---|---|
| 3,949,985 | A | | 4/1976 | Stampfli | |
| 3,974,611 | A | | 8/1976 | Satterthwaite | |
| 4,129,916 | A | * | 12/1978 | Schlesinger et al. | 482/38 |
| 4,546,965 | A | | 10/1985 | Baxter et al. | |
| 4,932,648 | A | | 6/1990 | Ahrens | |
| D316,134 | S | | 4/1991 | Gianacakos | |
| 5,125,877 | A | | 6/1992 | Brewer | |
| 5,137,271 | A | | 8/1992 | Frankel | |
| 5,177,926 | A | | 1/1993 | Frankel | |
| 5,254,058 | A | | 10/1993 | Savigny | |
| 5,256,116 | A | | 10/1993 | Robinson | |
| 5,334,098 | A | | 8/1994 | Pope et al. | |
| 5,352,166 | A | | 10/1994 | Chang | |
| 5,387,158 | A | * | 2/1995 | Bertrand | 472/117 |
| D363,522 | S | | 10/1995 | Erlick | |
| 5,543,185 | A | | 8/1996 | Christensen | |
| 5,549,195 | A | | 8/1996 | Aulagner | |
| D374,902 | S | | 10/1996 | Bookstaver et al. | |
| 5,634,687 | A | | 6/1997 | Gamble | |
| 5,688,180 | A | * | 11/1997 | Siragusa et al. | 472/116 |
| 5,732,954 | A | | 3/1998 | Strickler et al. | |
| 5,815,989 | A | | 10/1998 | Bennenk et al. | |
| 5,816,980 | A | | 10/1998 | Myszka et al. | |
| D401,640 | S | * | 11/1998 | Van Wagenen | D21/811 |
| 5,899,838 | A | * | 5/1999 | Jacobs | 482/142 |
| 5,941,041 | A | | 8/1999 | Robinson et al. | |
| D418,189 | S | | 12/1999 | Zeilinger | |
| 6,063,015 | A | * | 5/2000 | Johnston | 482/142 |
| D431,617 | S | * | 10/2000 | Harley | D21/691 |
| 6,193,633 | B1 | | 2/2001 | Jonas et al. | |
| 6,402,663 | B1 | | 6/2002 | Popp | |
| 6,419,587 | B1 | | 7/2002 | Geyer | |
| 6,419,610 | B1 | | 7/2002 | Jonas et al. | |
| 6,629,907 | B2 | | 10/2003 | Popp | |
| D496,423 | S | * | 9/2004 | Byrd | D21/827 |
| 6,992,550 | B2 | * | 1/2006 | Rawnick et al. | 333/263 |
| 7,322,910 | B2 | * | 1/2008 | Denoth et al. | 482/142 |
| 2002/0098949 | A1 | * | 7/2002 | Popp | 482/37 |

FOREIGN PATENT DOCUMENTS

| | | | | |
|---|---|---|---|---|
| DE | 29813334 | U1 | * | 11/1998 |
| DE | 20208852 | U1 | * | 8/2002 |
| WO | WO 9605899 | A1 | * | 2/1996 |

OTHER PUBLICATIONS

Admitted Prior Art Building A Climbing Wall, Metolius Mountain Products, Mar. 1997.

Admitted Prior Art Swing'N'Slide Challenge Mountain (Date Unknown), pp. 1-7.

Admitted Prior Art Step 2 Climb Ladder (Date Unknown), p. 1.

* cited by examiner

ARCHED CLIMBING PANEL

FIELD OF THE INVENTION

The invention relates to children's playground equipment, and more particularly to climbing panels for playground equipment.

BACKGROUND OF THE INVENTION

Playground equipment often includes an elevated platform on which children can play, and from which they can access slides and other equipment. Often, there are steps connected to the elevated platform so that children can climb up to the elevated platform from ground level. Additionally, there are often one or more climbing panels that provide an alternative or additional option for climbing up to the elevated platform.

SUMMARY OF THE INVENTION

The present invention provides a reversible arched climbing panel that is suited for use with a variety of playstations having elevated platforms of differing heights. The arched climbing panel is curved about an axis at a non-constant radius such that when oriented in a first orientation, the climbing panel extends to a first mounting height, and when oriented in a second orientation, the climbing panel extends to a second mounting height that is different from the first mounting height.

More specifically, the invention provides a climbing panel including a body that is curved about an axis at a non-constant radius of curvature. The body has first and second end portions and is configured for use such that one of the first and second end portions is supported by a support surface and the other of the first and second end portions is coupled to an elevated support structure. The body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height.

In one aspect of the invention, the first and second end portions each include a first recessed portion configured to receive a fastener for coupling the end portion to the elevated support structure and a second recessed portion configured to receive a stake extending from the support surface. In another aspect of the invention, the body includes a plurality of apertures configured to receive the hands or feet of a user climbing on the climbing panel. Each of the plurality of apertures can extend entirely through the body. In a further aspect of the invention, the body defines first and second oppositely-facing surfaces, and at least one of the first and second oppositely-facing surfaces includes a raised ridge portion extending around a perimeter of at least one of the plurality of apertures.

The invention also provides a playstation defining an elevated support structure and including the arched climbing panel described above. In one aspect of the invention, the playstation can include a planar climbing panel coupled to the elevated support structure adjacent one end of the arched climbing panel.

Other features and advantages of the invention will become apparent to those skilled in the art upon review of the following detailed description, claims, and drawings.

Figure 1:
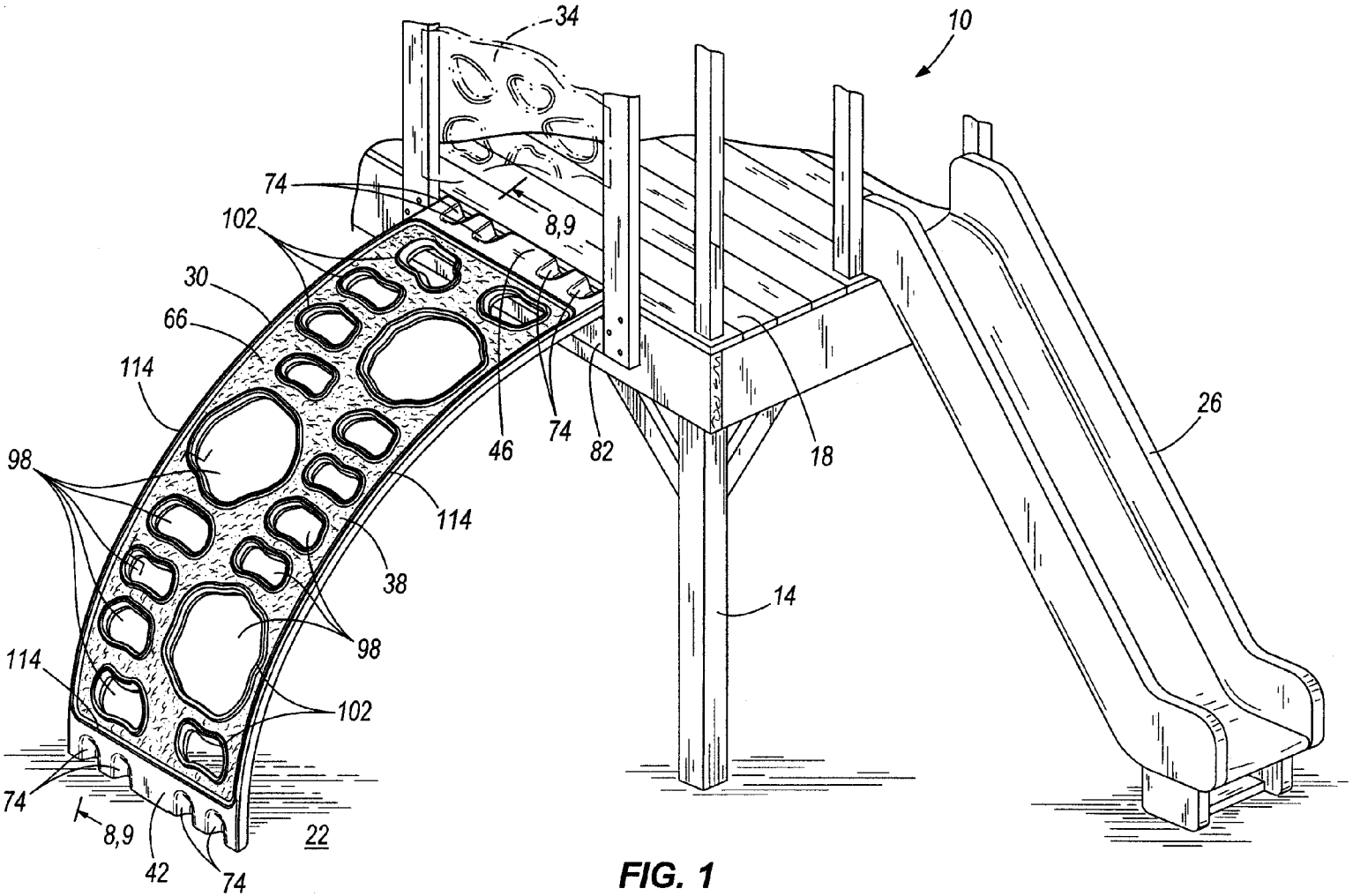
FIG. 1 is a perspective view of a playstation including an arched climbing panel embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a playstation 10 of the type typically used by children for recreational play. The playstation 10 includes a plurality of legs 14 (only one is shown) that support an elevated support structure or platform 18 above a lower support surface, such as the ground 22. As shown, a slide 26 may be coupled to the playstation 10 to allow children to slide from the platform 18 down to the ground 22. While not shown, other rides and climbing features (e.g., swings, monkey bars, etc.) can also be coupled to the playstation 10.

An arched climbing panel 30 is coupled to the playstation 10 to provide a way for children to climb from the ground 22 up to the platform 18. Of course, the arched climbing panel 30 can also be used to climb from the platform 18 back down to the ground 22. In yet another alternative embodiment, a substantially planar climbing panel 34 (shown in phantom in FIG. 1) can be coupled to the playstation 10 adjacent the arched climbing panel 30 to provide an additional climbing configuration. The illustrated planar climbing panel is of the type described in U.S. Pat. Nos. 6,402,663 and 6,629,907 assigned to PlayStar Inc., which are hereby incorporated by reference.

Still referring to FIG. 1, the illustrated arched climbing panel 30 comprises a unitary body 38 that terminates in first and second end portions 42 and 46, respectively. In the illustrated embodiment, the end portions 42, 46 are integrally formed with the remainder of the body 38. However, in other embodiments, the end portions 42, 46 can be removably attached to the body to provide end portions having different mounting arrangements than the arrangement to be described in detail below. The illustrated arched climbing panel 30 is molded from a suitable plastic using a conventional blow molding technique. Of course, other suitable molding techniques (e.g., rotational molding) can also be used.

Figure 4:
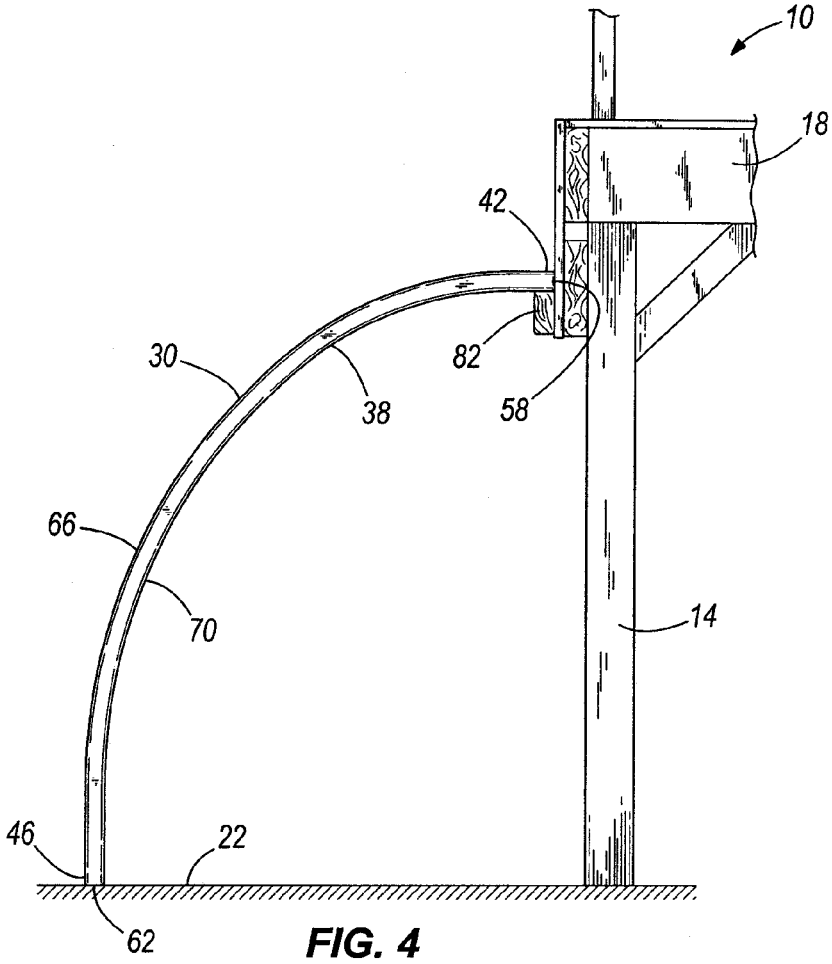
FIG. 4 is a side view of the arched climbing panel similar to FIG. 3, but shown coupled to a playstation with an elevated platform that is higher than the elevated platform shown in FIG. 3.
Figure 5:
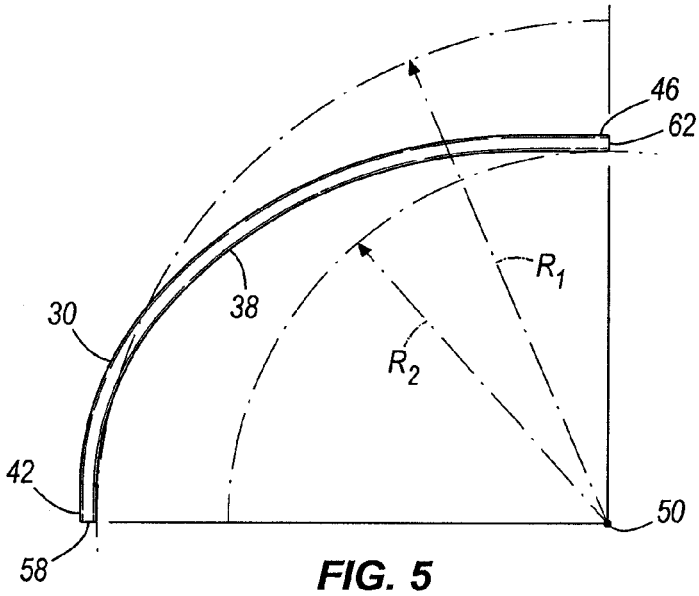
FIG. 5 is a side view of the arched climbing panel shown in the first orientation and illustrating the non-constant radius of curvature.

Referring now to FIG. 5, the body 38 is curved about an axis 50 at a non-constant radius of curvature. FIG. 5 illustrates just two of the radii of curvature $R_1$ and $R_2$ that are combined to arrive at the illustrated non-constant radius of curvature. By designing the body 38 to have a non-constant radius of curvature, the arched climbing panel 30 is reversible between a first orientation (see FIGS. 1, 2, and 5), where the first end 42 is adjacent the ground 22 and the second end 46 is coupled to the elevated platform 18 and extends to a first mounting height $H_1$ (see FIG. 2) above the ground 22, and a second orientation (see FIGS. 3 and 4), where the second end 46 is adjacent the ground 22 and the first end 42 is coupled to the elevated platform 18 and extends to a second mounting height $H_2$ (see FIG. 3) that is different from the first mounting height $H_1$. In the illustrated embodiment, the first mounting height $H_1$ is about three feet and the second mounting height $H_2$ is about four feet. Of course, the reversible arched climbing panel 30 can be designed to achieve any desirable mounting heights.

Figure 3:
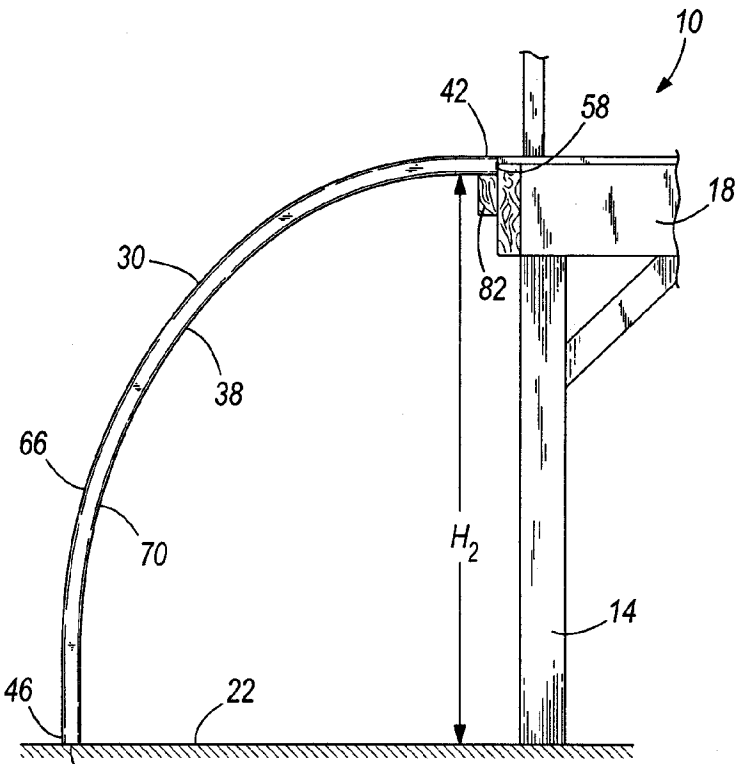
FIG. 3 is a side view of the arched climbing panel of FIG. 1 shown in a second orientation to extend to a second mounting height.
Figure 2:
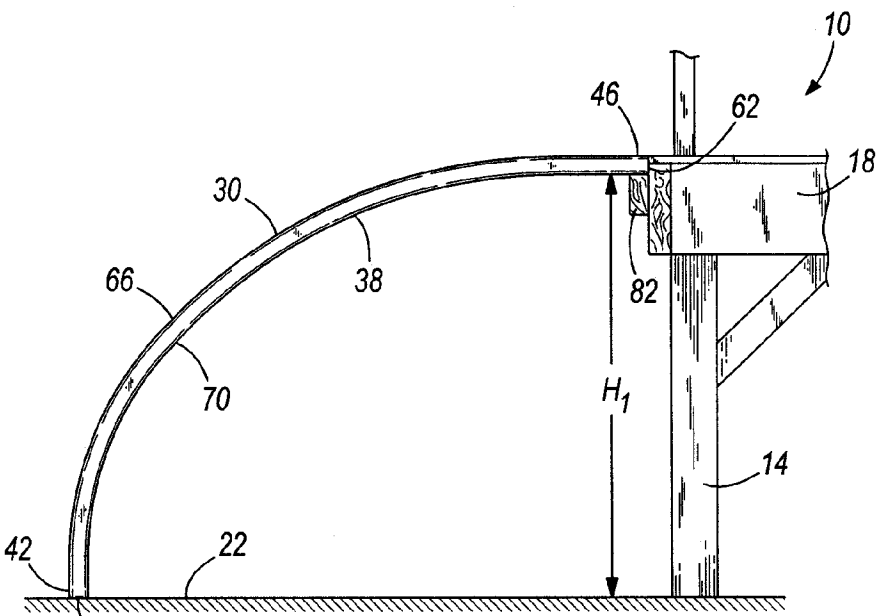
FIG. 2 is a side view of the arched climbing panel of FIG. 1 shown in a first orientation to extend to a first mounting height.

The reversible nature of the arched climbing panel 30 allows the panel 30 to be used with different playstations 10 having different platform 18 heights or to be used in different locations on the same playstation 10. For example, FIG. 2 illustrates the arched climbing panel 30 being used in the first orientation with a playstation 10 having a platform 18 elevated to about three feet. FIG. 3 illustrates the arched climbing panel 30 being used in the second orientation with a playstation 10 having a platform 18 elevated to about four feet. FIG. 4 also illustrates the arched climbing panel 30 in the second orientation, however, the arched climbing panel 30 is shown being used with a playstation 10 having a platform elevated to about five feet. With this arrangement, the user 54 (see FIGS. 8 and 9) will have a step up from the arched climbing panel 30 to the platform 18.

The first end portion 42 defines a first end surface 58 and the second end portion 46 defines a second end surface 62. To facilitate properly positioning the arched climbing panel 30 in either of the first or second orientations, the end surfaces 58 and 62 are oriented substantially normal to one another as best shown in FIGS. 2 and 3. This helps align and orient the arched climbing panel 30 during assembly.

Figure 6:
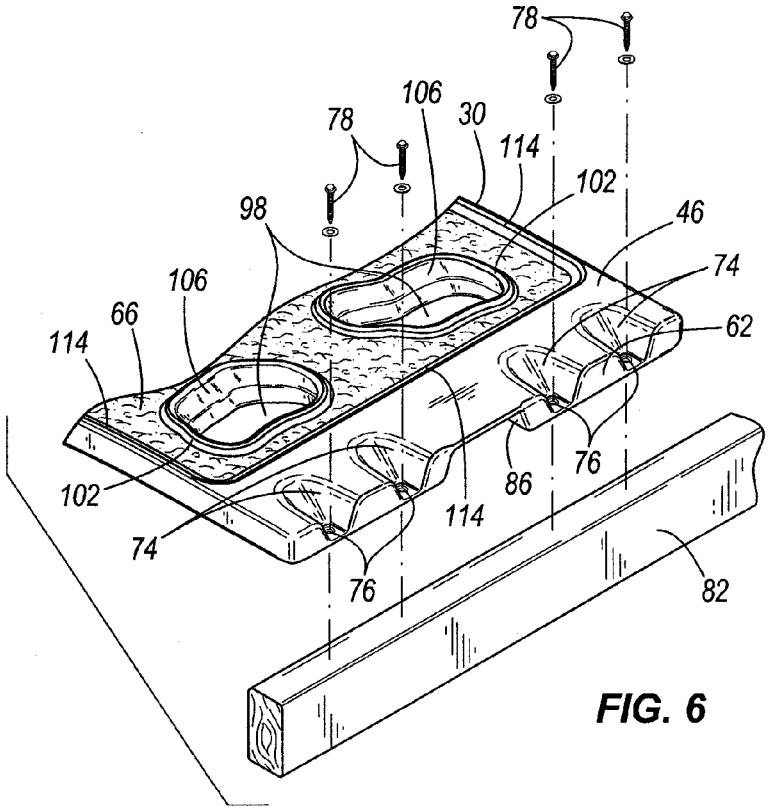
FIG. 6 is a partial perspective view of the arched climbing panel showing the end that is mounted to the playstation.
Figure 7:
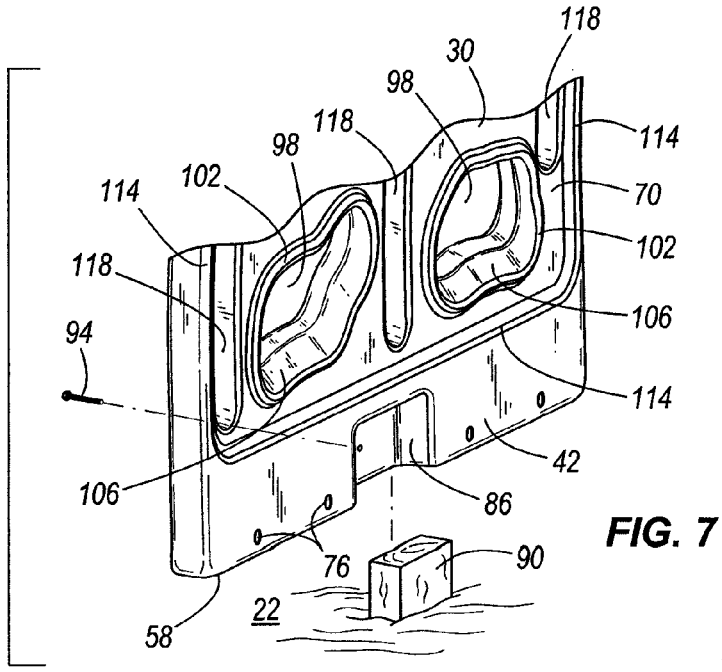
FIG. 7 is a partial perspective view of the arched climbing panel showing the end that is supported by the ground or other supporting surface.

As also shown in the illustrated embodiment, the first and second end portions 42, 46 are substantially identical to one another, thereby contributing to the reversibility of the arched climbing panel 30. As best shown in FIGS. 1, 6, and 7, the body 38 defines first and second oppositely-facing surfaces 66 and 70, respectively. Each end 42, 46 includes a plurality of recessed portions 74 (see FIGS. 1 and 6) formed in the first oppositely-facing surface 66 and that are configured with apertures 76 to receive fasteners 78 (see FIG. 6) for securing the arched climbing panel 30 to a mounting member 82 of the playstation 10. The recessed portions 74 allow the heads of the fasteners 78 to be recessed below the surface 66, thereby minimizing the chances that the user 54 will come into contact with the fasteners 78. As illustrated, there are four recessed portions 74 for receiving a respective four fasteners 78. However, those skilled in the art will understand that other suitable arrangements (e.g., more or fewer recesses, multiple fasteners per recess, etc.) can also be used.

As shown in FIG. 7, each end portion 42, 46 further includes a recessed portion 86 formed in the second oppositely-facing surface 70 and configured to receive a stake 90 that has been driven into or otherwise secured in the ground 22. In the illustrated embodiment, the recessed portion 86 is sized to accept the end of a standard 2"×4" board that has been partially driven into the ground 22. One or more fasteners 94 can be used to secure the arched climbing panel 30 to the stake 90. While staking the arched climbing panel 30 in the illustrated manner is optional, it can provide better support and stability to the arched climbing panel 30. Of course, other suitable configurations for staking or otherwise securing the arched climbing panel 30 to the ground 22 can also be substituted.

It should be noted that the illustrated configurations for the end portions 42 and 46 are well suited for mounting the reversible arched climbing panel 30 in the manner shown in the figures. However, the end portions 42, 46 can have alternate configurations designed for different mounting arrangements. For example, instead of the four recessed portions 74, the ends 42, 46 could include a flange extending generally parallel to the end surfaces 58, 62 for receiving fasteners that would be driven into the playstation 10 in a generally horizontal direction. In another alternative construction, the four recessed portions 74 could be eliminated and each end 42, 46 could include a thin lip extending substantially perpendicularly from the end surfaces 58, 62. The lip could rest upon the mounting member 82 or platform 18 and receive fasteners that would be driven in a generally vertical direction. Additionally, as mentioned above, the end portions 42, 46 could be separable from the body 38. If this were the case, one of the ends 42, 46 could include the four recessed portions 74 (or a substitute arrangement) and the other of the ends 42, 46 could include the recessed portion 86 (or a substitute arrangement). Once it was determined which orientation was to be used for the arched climbing panel 30, the appropriate end portion 42, 46 could be attached to the appropriate end of the body 38 to enable mounting to the playstation 10.

As best illustrated in FIGS. 1 and 6-9, the body 38 of the arched climbing panel 30 includes a plurality of apertures 98 configured to receive the hands (see FIG. 9) or feet (see FIG. 8) of the user 54 climbing on the arched climbing panel 30. In the illustrated embodiment, the plurality of apertures extend entirely through the body 38. However, in other embodiments, some or all of the apertures 98 could alternatively take the form of recesses that do not extend entirely through the body 38.

To facilitate grasping the arched climbing panel 30 while climbing, at least one of the oppositely-facing surfaces 66 and 70 includes raised grip or ridge portions 102 extending around at least a portion of the perimeter of at least one of the plurality of apertures 98. In the illustrated embodiment, there is a raised ridge portion 102 formed around the perimeter of each aperture 98 on both of the oppositely-facing surfaces 66 and 70.

Figure 8:
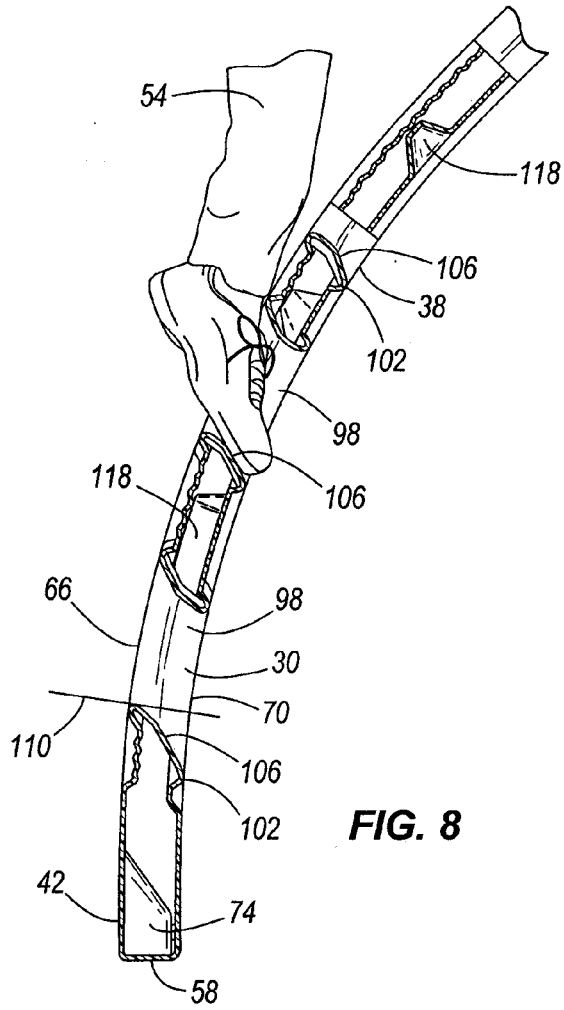
FIG. 8 is a partial section view taken along line 8-8 in FIG. 1.

As best shown in FIGS. 6-9, the perimeters of the apertures 98 are defined by sidewalls 106 extending between the oppositely-facing surfaces 66 and 70. At least some of the sidewalls 106 (e.g., especially those in the apertures 98 closer to the first and second end portions 42, 46) have portions that extend in a non-perpendicular manner between the oppositely-facing surfaces 66 and 70. For example, with reference to FIG. 8 illustrating the lower portion of the arched climbing panel 30, reference line 110 is shown to represent a line extending substantially perpendicularly between the oppositely-facing surfaces 66 and 70. The portion of the sidewall 106 directly below the reference line 110 is clearly not parallel with the reference line 110, thereby illustrating the substantially non-perpendicular manner in which that portion of the sidewall 106 extends between the oppositely-facing surfaces 66 and 70.

Figure 9:
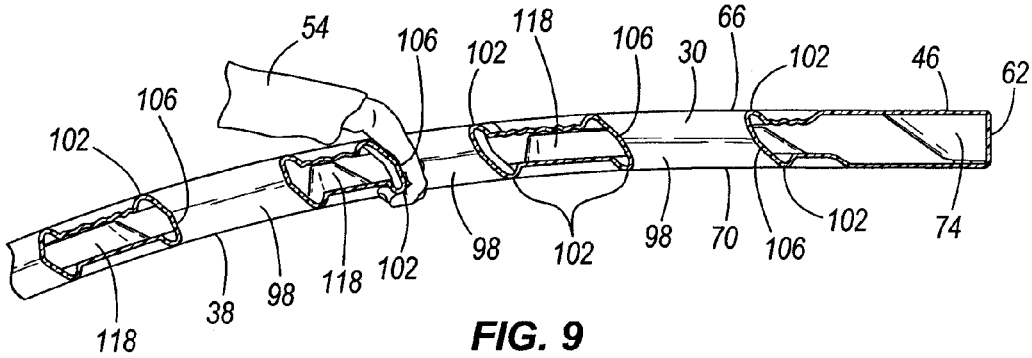
FIG. 9 is a partial section view taken along line 9-9 in FIG. 1.

These non-perpendicularly-extending sidewall portions facilitate the user 54 in climbing the arched climbing panel 30. As seen in FIG. 8 illustrating the lower portion of the arched climbing panel 30, the user's foot will be supported at an angle to provide a good forward-leaning position. Additionally, as shown in FIG. 9 illustrating the upper portion of the arched climbing panel 30, when the user's hand is extended upwardly to grasp through the apertures 98, the user 54 can comfortably reach and grasp the raised ridge portion 102 without excessive wrist over-extension. As can be seen from the sidewalls 106 shown in FIGS. 8 and 9, the advantageous angling of the sidewalls 106 will be present when the arched climbing panel 30 is in both the first and second orientations, again contributing to the reversibility of the arched climbing panel 30. Furthermore, the non-perpendicularly-extending sidewalls 106 that exist in the apertures 98 adjacent the end portions 42, 46 are advantageous to the molding process by creating draft angles that facilitate releasing of the arched climbing panel 30 from the mold.

As best illustrated in FIGS. 1, 6, and 7, the first and second oppositely-facing surfaces 66 and 70 each include a raised lip 114 that defines a perimeter in which the apertures 98 are located. The raised lips 114 can provide additional grasping features along the edges of the arched climbing panel 30. Additionally the raised lips 114 provide transitions between body 38 and the end portions 42, 46.

To provide a more realistic, natural climbing experience, the portion of the surface 66 within the raised lip 114 is textured. Additionally, the apertures 98 are irregularly shaped and spaced, and differ in size. Another feature incorporated into the design of the apertures 98 is the design of the two apertures 98 most closely adjacent each of the end portions 42 and 46. Specifically, these sets of apertures 98 are designed to be spaced generally the same distance from the respective end surfaces 58 and 62 such that the arched climbing panel 30 can be hung in a generally upright position from two spaced support bars. This is particularly useful for storing and displaying the arched climbing panels 30 in retail stores.

As best illustrated in FIGS. 7-9, the arched climbing panel 30 also includes molded-in strengthening cavities 118 formed in the surface 70. The cavities 118 vary in size and configuration and provide added strength and rigidity to the arched climbing panel 30.

Various features of the invention are set forth in the following claims.

The invention claimed is:

1. A climbing panel comprising:

a body that is curved about an axis at a non-constant radius of curvature and in only a single direction of curvature, the body including first and second end portions and being configured for use such that one of the first and second end portions is supported by a support surface and the other of the first and second end portions is coupled to an elevated support structure, the body further including first and second oppositely-facing surfaces, at least a portion of each surface being curved about the axis, the body also including at least one of a plurality of raised grip portions and a plurality of apertures sized and configured to receive the hands or feet of a user climbing the panel;

wherein the body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height.

2. The climbing panel of claim 1, wherein the first end portion defines a first end surface and the second end portion defines a second end surface, the first and second end surfaces being oriented substantially normal to one another.

3. The climbing panel of claim 1, wherein the first and second end portions are substantially identical to one another.

4. The climbing panel of claim 1, wherein the first and second end portions each include;

a first recessed portion configured to receive a fastener for coupling the end portion to the elevated support structure; and a second recessed portion configured to receive a stake extending from the support surface.

5. The climbing panel of claim 4, wherein the first recessed portion is formed in the first oppositely-facing surface and the second recessed portion is formed in the second oppositely-facing surface.

6. The climbing panel of claim 1, wherein the body includes a plurality of apertures configured to receive the hands or feet of a user climbing on the climbing panel.

7. The climbing panel of claim 6, wherein at least one of the first and second oppositely-facing surfaces includes a raised grip portion extending around a perimeter of at least one of the plurality of apertures.

8. The climbing panel of claim 7, wherein both of the first and second oppositely-facing surfaces include raised grip portions extending around a perimeter of at least one of the plurality of apertures.

9. The climbing panel of claim 6, wherein the perimeters of the apertures are defined by sidewalls extending between the first and second oppositely-facing surfaces, at least some of the sidewalls having portions that extend in a non-perpendicular manner between the adjacent first and second oppositely-facing surfaces.

10. The climbing panel of claim 6, wherein each of the plurality of apertures extends entirely through the body.

11. The climbing panel of claim 1, wherein the first mounting height is approximately three feet and the second mounting height is approximately four feet.

12. A playstation comprising:

an elevated support structure positioned above a lower support surface; and a climbing panel including, a body that is curved about an axis at a non-constant radius of curvature and in only a single direction of curvature, the body including first and second end portions and being configured for use such that one of the first and second end portions is supported by the support surface and the other of the first and second end portions is coupled to the elevated support structure the body further including first and second oppositely-facing surfaces, at least a portion of each surface being curved about the axis the body also including at least one of a plurality of raised grip portions and a plurality of apertures sized and configured to receive the hands or feet of a user climbing the panel;

wherein the body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height.

13. The playstation of claim 12, wherein the first end portion defines a first end surface and the second end portion defines a second end surface, the first and second end surfaces being oriented substantially normal to one another.

14. The playstation of claim 12, wherein the first and second end portions are substantially identical to one another.

15. The playstation of claim 12, wherein the first and second end portions each include;

a first recessed portion configured to receive a fastener for coupling the end portion to the elevated support structure; and a second recessed portion configured to receive a stake extending from the support surface.

16. The playstation of claim 15, wherein the first recessed portion is formed in the first oppositely-facing surface and the second recessed portion is formed in the second oppositely-facing surface.

17. The playstation of claim 12, wherein the body includes a plurality of apertures configured to receive the hands or feet of a user climbing on the climbing panel.

18. The playstation of claim 17, wherein at least one of the first and second oppositely-facing surfaces includes a raised grip portion extending around a perimeter of at least one of the plurality of apertures.

19. The playstation of claim 18, wherein both of the first and second oppositely-facing surfaces include raised grip portions extending around a perimeter of at least one of the plurality of apertures.

20. The playstation of claim 17, wherein the perimeters of the apertures are defined by sidewalls extending between the first and second oppositely-facing surfaces, at least some of the sidewalls having portions that extend in a non-perpendicular manner between the adjacent first and second oppositely-facing surfaces.

21. The playstation of claim 17, wherein each of the plurality Of apertures extends entirely through the body.

22. The playstation of claim 12, wherein the first mounting height is approximately three feet and the second mounting height is approximately four feet.

23. The playstation of claim 12, further comprising a planar climbing panel coupled to the elevated support structure adjacent the end portion that is coupled to the elevated support structure.

24. A climbing panel comprising:

a body that is curved about an axis at a non-constant radius of curvature, the body including first and second end portions and being configured for use such that one of the first and second end portions is supported by a support surface and the other of the first and second end portions is coupled to an elevated support structure;

wherein the body includes a plurality of apertures configured to receive the hands or feet of a user climbing on the climbing panel, each of the plurality of apertures extending entirely throughout the body; and wherein the body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height.

25. The climbing panel of claim 24, wherein the body defines first and second oppositely-facing surfaces, and wherein at least one of the first and second oppositely-facing surfaces includes a raised ridge portion extending around a perimeter of at least one of the plurality of apertures.

26. The climbing panel of claim 25, wherein both of the first and second oppositely-facing surfaces include raised ridge portions extending around a perimeter of at least one of the plurality of apertures.

27. The climbing panel of claim 24, wherein the body defines first and second oppositely-facing surfaces, and wherein the perimeters of the apertures are defined by sidewalls extending between the first and second oppositely-facing surfaces, at least some of the sidewalls having portions that extend in a non-perpendicular manner between the adjacent first and second oppositely-facing surfaces.

28. A climbing panel comprising:

a body that is curved about an axis at a non-constant radius of curvature, the body including first and second end portions and being configured for use such that one of the first and second end portions is supported by a support surface and the other of the first and second end portions is coupled to an elevated support structure;

wherein the body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height; and wherein the first and second end portions each include;

a first recessed portion configured to receive a fastener for coupling the end portion to the elevated support structure; and a second recessed portion configured to receive a stake extending from the support surface.

29. The climbing panel of claim 28, wherein the body defines first and second oppositely-facing surfaces, and wherein the first recessed portion is formed in the first surface and the second recessed portion is formed in the second surface.

30. A climbing panel comprising:

a body that is curved about an axis at a non-constant radius of curvature, the body including first and second end portions and being configured for use such that one of the first and second end portions is supported by a support surface and the other of the first and second end portions is coupled to an elevated support structure;

wherein the body includes a plurality of apertures configured to receive the hands or feet of a user climbing on the climbing panel;

wherein the body defines first and second oppositely-facing surfaces;

wherein the perimeters of the apertures are defined by sidewalls extending between the first and second oppositely-facing surfaces, at least some of the sidewalls having portions that extend in a non-perpendicular manner between the adjacent first and second oppositely-facing surfaces; and wherein the body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height.

31. The climbing panel of claim 30, wherein at least one of the first and second oppositely-facing surfaces includes a raised ridge portion extending around a perimeter of at least one of the plurality of apertures.

32. The climbing panel of claim 31, wherein both of the first and second oppositely-facing surfaces include raised ridge portions extending around a perimeter of at least one of the plurality of apertures.

33. A playstation comprising:

an elevated support structure positioned above a lower support surface;

a climbing panel including, a body that is curved about an axis at a non-constant radius of curvature and in only a single direction of curvature, the body including first and second end portions and being configured for use such that one of the first and second end portions is supported by the support surface and the other of the first and second end portions is coupled to the elevated support structure, the body further including first and second oppositely-facing surfaces, at least a portion of each surface being curved about the axis;

wherein the body is reversible between a first orientation, where the first end is adjacent the support surface and the second end is coupled to the elevated support structure and extends to a first mounting height, and a second orientation, where the second end is adjacent the support surface and the first end is coupled to the elevated support structure and extends to a second mounting height that is different from the first mounting height; and a planar climbing panel coupled to the elevated support structure adjacent the end portion that is coupled to the elevated support structure.

* * * * *

UNITED STATES PATENT AND TRADEMARK OFFICE

CERTIFICATE OF CORRECTION

PATENT NO. : 7,594,875 B2
APPLICATION NO. : 10/962094
DATED : September 29, 2009
INVENTOR(S) : Brian K. Zeilinger et al.

It is certified that error appears in the above-identified patent and that said Letters Patent is hereby corrected as shown below:

Column 6, Claim 12, line 64:

change "structure the body further including first and second..." to --structure, the body further including first and second...--.

Column 6, Claim 12, line 66:

change "being curved about the axis the body also" to --being curved about the axis, the body also--.

Signed and Sealed this

Twelfth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,594,875 B2
APPLICATION NO. : 10/962094
DATED : September 29, 2009
INVENTOR(S) : Zeilinger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1140 days.

Signed and Sealed this

Twenty-eighth Day of September, 2010

David J. Kappos

David J. Kappos
*Director of the United States Patent and Trademark Office*